US008794994B2

(12) United States Patent
Köllmann et al.

(10) Patent No.: US 8,794,994 B2
(45) Date of Patent: Aug. 5, 2014

(54) CONNECTION TERMINAL

(71) Applicant: WAGO Verwaltungsgesellschaft mbH, Minden (DE)

(72) Inventors: Hans-Josef Köllmann, Minden (DE); Michael Meyer, Wiedensahl (DE); Wolfgang Gerberding, Hess.-Oldendorf (DE)

(73) Assignee: Wago Verwaltungsgesellschaft mbH, Minden (DE)

( * ) Notice: Subject to any disclaimer, the term of this patent is extended or adjusted under 35 U.S.C. 154(b) by 26 days.

(21) Appl. No.: 13/713,179

(22) Filed: Dec. 13, 2012

(65) Prior Publication Data

US 2013/0157520 A1 Jun. 20, 2013

(30) Foreign Application Priority Data

Dec. 14, 2011 (DE) ..... 10 2011 056 410

(51) Int. Cl.
*H01R 4/24* (2006.01)
*H01R 4/48* (2006.01)

(52) U.S. Cl.
CPC ..... *H01R 4/4818* (2013.01)
USPC ..... 439/441

(58) Field of Classification Search
CPC ..... H01R 4/4818; H01R 2103/00
USPC ..... 439/441, 439
See application file for complete search history.

(56) References Cited

U.S. PATENT DOCUMENTS

| | | | | |
|---|---|---|---|---|
| 6,146,187 | A * | 11/2000 | Pallai | 439/441 |
| 8,113,858 | B1 * | 2/2012 | Chiang | 439/188 |
| 2010/0081316 | A1 * | 4/2010 | Eppe et al. | 439/441 |

FOREIGN PATENT DOCUMENTS

| | | | |
|---|---|---|---|
| DE | 1898970 | U | 8/1964 |
| DE | 1975279 | U | 12/1967 |
| DE | 42334466 | C1 | 10/1993 |
| DE | 202009010003 | U1 | 12/2009 |
| DE | 29915515 | U1 | 2/2011 |
| EP | 1622224 | B1 | 6/2009 |
| JP | 2003249283 | A | 5/2003 |

* cited by examiner

*Primary Examiner* — Phuong Dinh
(74) *Attorney, Agent, or Firm* — Renner, Otto, Boisselle & Sklar, LLP.

(57) ABSTRACT

A connection terminal having at least one busbar piece and at least one clamping spring. The connection terminal has at least one spring-force clamping connection formed from a clamping spring and a portion of a busbar piece, an insulating-material housing including at least one conductor insertion opening which leads to an spring-force clamping connection and extends in a conductor insertion direction, and at least one pivotably mounted operating lever designed to interact with at least one clamping spring in order to open at least one spring-force clamping connection. The operating lever can be arranged with its rotation axis in the conductor insertion opening or in the path of the conductor insertion opening in the direction of the clamping point. The connection terminal provides a space-saving and compact construction, which is also improved in respect of the force effect of the operating lever.

11 Claims, 6 Drawing Sheets

CONNECTION TERMINAL

TITLE OF THE INVENTION

Connection terminal

FIELD OF THE INVENTION

The invention relates to a connection terminal having:

at least one busbar piece and at least one clamping spring, with the connection terminal having at least one spring-force clamping connection, which is formed from a clamping spring and a portion of a busbar piece, in order to clamp an electrical conductor at a clamping point between a clamping portion of the clamping spring and the busbar piece portion, and having an insulating-material housing which has at least one conductor insertion opening which leads to an associated spring-force clamping connection and extends in a conductor insertion direction, and having at least one pivotably mounted operating lever which is designed to interact with at least one clamping spring by means of an operating portion in order to open at least one associated spring-force clamping connection when the operating lever is pivoted, and has an operating arm which adjoins the operating portion.

BACKGROUND OF THE INVENTION

DE 299 15 515 U1 discloses a spring terminal for connecting electrical conductors having an insulating-material housing which has a connection clip with a clamping spring which interacts with a busbar piece. The insulating-material housing has an integrated operating element in the form of an eccentric lever which is rotatably mounted in the insulating-material housing. The rotation axis of the eccentric lever is situated substantially vertically over the clamping point.

DE 87 04 494 U1 discloses a connection terminal having a spring-force clamping connection and an operating lever. The operating lever is pivotably mounted beneath the clamping spring behind the clamping point, as seen in the conductor insertion direction, by way of its rotation axis. An operating tab is bent at the free clamping limb end and interacts with an operating finger of the operating lever in order to open the spring-force clamping connection.

SUMMARY OF THE INVENTION

Proceeding from the above, the object of the present invention is to create an improved connection terminal which is as small as possible and has a spring-force terminal connection and operating lever which is also improved in respect of the force effect of the operating lever on the connection terminal.

The object is achieved by the connection terminal having the features of claim 1.

In a connection terminal of the generic type cited in the introductory part, the rotation axis of the operating lever is arranged transverse to the conductor insertion direction in an associated conductor insertion opening or the extension of the conductor insertion opening continuing in the conductor insertion direction to the clamping point.

On account of the operating lever being arranged with its rotation axis in the conductor insertion opening or in the path of the conductor insertion opening in the direction of the clamping point, the operating lever rotates in the region of the clamping point or in the space in front of it. This has the advantage that the operating lever can be accommodated in the insulating-material housing in an extremely space-saving manner and, in the process, at the same time serves as a wall of the conductor insertion channel for guiding an electrical conductor. Therefore, the operating lever replaces a portion of the guide wall for an electrical conductor of the conductor insertion opening.

Positioning the rotation axis in the region of the clamping point or in the path of the conductor insertion opening situated in front of it additionally has the kinematic advantage that the clamping spring is operated relatively close to the rotation axis, this reducing the lever forces on the insulating-material housing.

It is therefore advantageous when the operating lever has at least one lateral boundary wall for guiding an electrical conductor, which is inserted into a conductor insertion opening in the conductor insertion direction, to an associated clamping point.

It is particularly advantageous when the at least one operating lever is arranged so as to be adjacent to an associated busbar portion, which forms the clamping point, such that the rotation axis of the operating lever is arranged in the space between the plane which is spanned by the busbar piece portion and the plane which is parallel thereto and which is defined by the clamping edge of the clamping spring, which is fully open when the operating lever is pivoted. In this case, the operating lever is preferably positioned beneath the busbar piece portion in the conductor insertion direction somewhat in front of or directly beneath the clamping point by way of its rotation axis. The busbar in the portion which forms the clamping point defines, irrespective of any raised portions for a contact edge, a first plane in relation to which a second imaginary plane is spanned. This second plane is spaced apart from the plane of the busbar piece in such a way that the clamping edge of an open clamping spring touches this plane. The intermediate space between the planes forms the preferred space in which the rotation axis of the operating lever should be located, in order to provide a mechanically stable connection terminal which is of extremely compact construction.

It is particularly advantageous when at least one operating lever enters a cutout in the busbar piece, which cutout is made so as to adjoin a clamping portion of the associated busbar piece. The operating lever then acts, by way of an operating portion, on an operating tab which is arranged next to the clamping portion of the clamping spring as seen over the width of an associated clamping spring, in order to open the clamping spring. It is possible to accommodate the operating lever in a space-saving manner with the aid of the cutout on a side edge of the busbar piece. An operating tab is then produced on the clamping portion of the clamping spring beneath said cutout as seen in the width of the busbar piece and the associated clamping spring, said operating tab then being acted on by the operating portion of the operating lever when the operating lever is pivoted, in order to open the clamping spring. Electrical contact is then made with an electrical conductor adjacent to this portion of the busbar piece or, as seen over the width, adjacent to the operating tab by the clamping portion of the clamping spring and a contact edge of the busbar piece which is preferably situated in front.

The operating tab is preferably released by the clamping spring, for example by being stamped free or cut free, and projects obliquely from the clamping portion of the clamping spring.

The at least one clamping spring is preferably in the form of a clamping spring which is bent in the shape of a U and of which the free clamping portion points obliquely in the direction of an associated busbar piece. With the aid of a clamping spring of this kind which is bent in the shape of a U, it is possible to directly clamp in an electrical conductor without first opening the clamping spring by way of the associated operating lever. This is also known as a direct plug-connection technique.

In a preferred embodiment, the at least one operating lever has a projecting pivot pin only on one side. This pivot pin is then accommodated in a corresponding opening in the insulating-material housing of the connection terminal and the rotation axis which is defined by the rotation speed. Therefore, the operating lever is mounted in the insulating-material housing of the connection terminal in a rotatable manner on one side with the aid of the pivot pin. In contrast, on the side opposite the one pivot pin, the operating lever is guided only by a wall of the insulating-material housing without a defined pivot pin.

The at least one operating lever preferably has an operating arm which extends in the conductor insertion direction in the closed state of the associated spring-force terminal connection. Therefore, the free end of the operating arm ends opposite the conductor insertion opening in the region of the rear side of the connection terminal. Therefore, a very compact construction of the connection terminal is possible.

However, it is also feasible for the at least one operating lever to have an operating arm which extends in the conductor insertion direction or counter to said conductor insertion direction on the lower side or the upper side of the connection terminal. In order to achieve variants of the connection terminal which are of as compact construction as possible, combinations are feasible, in particular, in which the operating arms of the operating levers extend alternately in the conductor insertion direction and counter to said conductor insertion direction or alternately on the lower side and upper side in the same directions or alternately in opposite directions.

These embodiments are particularly dependent on the specific combination of spring-force connection terminals and the physical position thereof in relation to one another.

In an embodiment which is preferred in this respect, the connection terminal has at least one pair of opposing spring-force connection terminals with conductor insertion openings which run toward one another on the opposing front side and rear side of the connection terminal. In this embodiment, electrical conductors can therefore be inserted both from the front side and from the rear side of the connection terminal in opposing conductor insertion directions and associated spring-force connection terminals can make contact with them. Each spring-force connection terminal of a pair of conductor insertion openings of this kind which are situated opposite one another, possibly with an offset, in each case has an operating lever with an operating arm, the operating arms of said operating levers pointing away from one another in opposite directions.

In this case, the operating arms are preferably accommodated in the space between two conductor insertion openings above and beneath the conductor insertion openings on the upper side or lower side of the connection terminal in associated recesses in the insulating-material housing.

In this embodiment it is particularly preferred when the operating arms of a pair of operating levers are arranged on the same side or alternatively on opposite sides of the connection terminal.

BRIEF DESCRIPTION OF THE SEVERAL VIEWS OF THE DRAWINGS

The invention will be explained in greater detail below with reference to exemplary embodiments together with the appended drawings, in which.

DETAILED DESCRIPTION OF THE INVENTION

Figure 1:
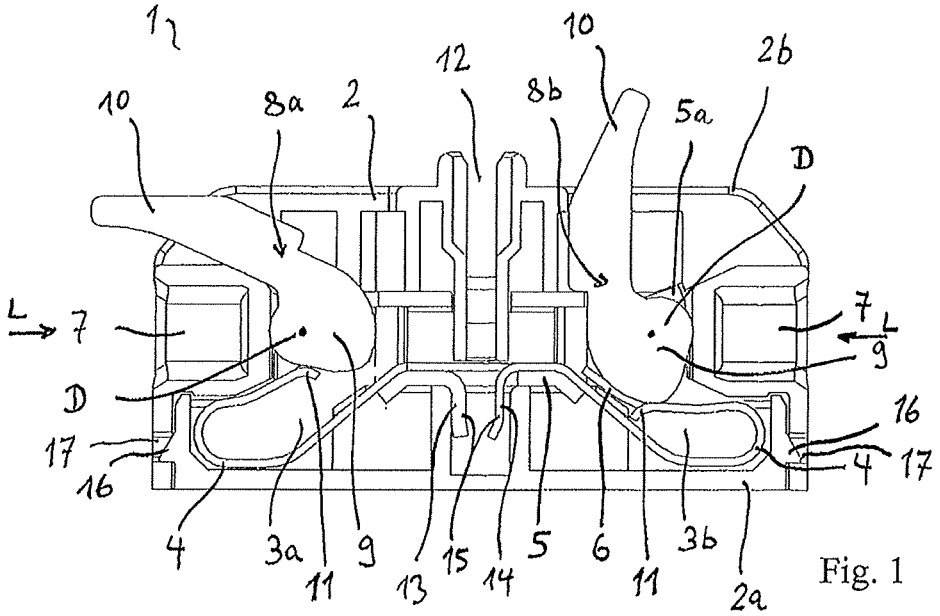
FIG. 1 shows a sectional side view of a twin connection terminal having two spring-force connections and associated operating levers.

FIG. 1 shows a connection terminal 1 having an insulating-material housing 2 in which at least one pair of spring-force terminal connections 3*a*, 3*b* which are situated opposite one another are installed. The spring-force terminal connections 3*a*, 3*b* each have a clamping spring 4 which is bent in the shape of a U, and also a common busbar piece 5.

Each spring-force terminal connection 3*a*, 3*b* provides a clamping point by means of a clamping portion 6 which is formed on the free, moving end of the clamping spring, and in particular by means of the clamping edge at the free end of the clamping spring 4 and also on that busbar piece portion 5*a* which is situated opposite the clamping portion 6. In order to insert an electrical conductor to the clamping point, an associated conductor insertion opening 7 is made in the insulating-material housing for each spring-force terminal connection 3*a*, 3*b*. The conductor insertion opening 7 has a diameter which is matched to the maximum possible permissible cross section together with the insulating-material casing of an electrical conductor.

In order to open the clamping springs 4, each spring-force terminal connection 3*a*, 3*b* has an operating lever 8 with an operating portion 9 and also an operating arm 10 which adjoins said operating portion and extends in a longitudinal direction.

In FIG. 1, the operating lever 8*a* on the left-hand side is shown in the closed position of the clamping spring, and the operating lever 8*b* on the right-hand side is shown in the open position of the clamping spring. It can be seen that the operating levers 8*a*, 8*b* are pivoted from the closed position to the open position through approximately 90°. It is clear that the operating lever 8*a*, by way of its operating portion 9 and in particular the rotation axis D about which the operating lever 8*a*, 8*b* is mounted in a pivotable manner in the insulating-material housing 2 of the connection terminal, is arranged in the space in the associated conductor insertion opening 7 or in the conductor insertion direction L to the clamping point in the continuing extension of the conductor insertion opening 7. However, the rotation axis D, as seen in the conductor insertion direction L, is still positioned in front of the clamping point and is in no way situated behind the clamping portion 6 of the clamping spring 4 as seen in the conductor insertion direction L.

Said figure also shows that, as seen in the direction of the width of the clamping spring 4, an operating tab 11 is released in addition to the clamping portion 6 and projects obliquely from the clamping portion 6. An eccentric-like, projecting contour of the operating portion 9 of the associated operating lever 8*a*, 8*b* acts at least partially on said operating tab 11 during the movement sequence when the operating lever 8*a*, 8*b* is pivoted from the closed position (operating lever 8*a* on the left-hand side) to the open position (operating lever 8*b* on the right-hand side). In this way, the clamping portion 6 of the clamping spring 4 is moved away from the adjacent busbar piece portion 5*a* which forms the clamping point, in order to open the clamping spring 4.

Said figure also shows that the operating levers 8*a*, 8*b* is accommodated in recesses in the insulating-material housing 2 for to accommodate part of the operating arm 10. In this case, the operating arm 10, in the closed position (operating arm 8*a* on the left-hand side in FIG. 1) projects in the opposite direction to the conductor insertion direction L on the respective front side of the associated conductor insertion opening 7 out of the insulating-material housing 2.

An embodiment in which the operating arm 10 is rotated through 180° and points in the conductor insertion direction L in the closed position is optionally also feasible. This is feasible, in particular, for a connection terminal in which only one spring-force terminal connection is present over the illustrated length of the connection terminal in the conductor insertion direction L and a plurality of spring-force terminal connections are arranged in a manner distributed over the width as seen in the viewing direction of FIG. 1.

In the connection terminal 1 illustrated in FIG. 1, it is feasible for not only such a pair of spring-force terminal connections 3*a*, 3*b* to be provided with associated operating levers 8*a*, 8*b*, but also for a plurality of such arrangements to be arranged next to one another over the width of the connection terminal as seen in the viewing direction.

It is also clear from FIG. 1 that, in the illustrated exemplary embodiment, a link insertion opening 12 is provided on the upper side of the insulating-material housing, said link insertion opening being open to the upper side of the insulating-material housing 2. The link insertion opening 12 issues into a link terminal connection which is formed by a material tab 13 of the busbar 5 and an end 14, which is bent downward, of a clamping spring 4. In this way, busbars 5 which are arranged next to one another and have associated spring-force terminal connections 3*a*, 3*b* can be electrically conductively connected to one another over the width, as seen in the viewing direction of FIG. 1, as desired. Links of this kind have at least two comb tines which extend in parallel and are electrically conductively connected to one another by means of a web which runs transversely to said comb tines. At least this transversely running web can be surrounded by an insulating casing in a manner which is known per se.

It is also clear that the insulating-material housing 2 is of two-part construction and has a lower part 2*a* onto which an upper part 2*b* is latched. To this end, latching lugs 16 of the lower part 2*a* enter associated latching openings 17 in the upper part 2*b*.

Figure 2:
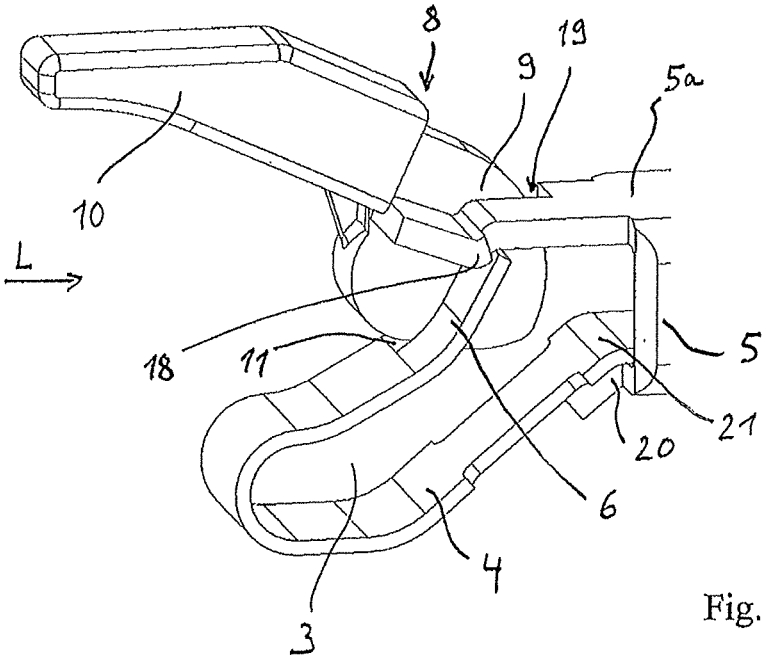
FIG. 2 shows a perspective view of a spring-force terminal connection having associated operating levers in the closed position.

FIG. 2 shows a perspective view of a spring-force terminal connection 3 which is formed from a clamping spring 4, which is bent in the shape of a U, and a busbar piece portion 5*a*. It is clear that the busbar piece portion 5*a* which forms the clamping point has a clamping projection 18 at its free end, said clamping projection providing a defined abutment area of reduced surface area for an electrical conductor. The clamping force of the clamping spring 4 is then concentrated onto this clamping area, which is defined by the clamping projection 18, by means of the electrical conductor, so that the surface pressure is increased in comparison to a planar bearing area. It is also clear that the free end of the busbar piece portion 5*a* which forms the clamping point is angled obliquely upward in order to provide a guide for an electrical conductor to the clamping edge 18.

It is also clear that the busbar piece portion 5*a* which forms the clamping point has a cutout 19 in the form of a depression, which the operating portion 9 of the operating lever 8 enters, laterally adjacent to the clamping edge 18. As seen over the width of the clamping spring 4, that is to say approximately in the viewing direction of FIG. 2, the operating tab 11 is released by the clamping portion 6 of the clamping spring 4 beneath this cutout 19 and extends in the direction of the conductor insertion direction L.

It is clear that the side wall of the operating portion 9 of the operating lever 8 forms a lateral boundary wall for an electrical conductor which is inserted to the clamping point, said boundary wall being used to guide the electrical conductor to the clamping point.

Behind the busbar piece portion 5*a* which forms the clamping point, the busbar 5 is laterally folded over in such a way that a bearing area 20 for supporting an abutment limb 21 of the clamping spring 4 is created at a distance from and parallel to the busbar piece portion 5*a* which forms the clamping point.

Figure 3:
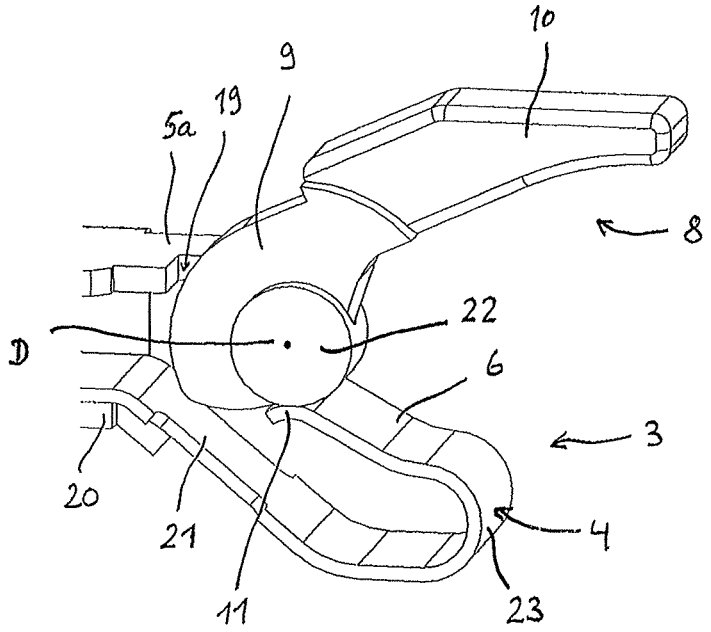
FIG. 3 shows a spring-force terminal connection having an operating lever from FIG. 2, as seen from the other side.

FIG. 3 shows a perspective view of the spring-force terminal connection 3 having an operating lever 8 from FIG. 2 from the other side. It is clear that a pivot pin 22 projects from the operating portion 9 only on that side which can be seen in FIG. 3. The pivot pin 22 is circular and therefore defines the rotation axis D about which the operating lever 8 is accommodated in the insulating-material housing 2 in a rotatable manner. The pivot pin 22 is provided in order to enter a corresponding opening or recess (not illustrated) in the insulating-material housing of the connection terminal 1. Therefore, the operating lever 8 is mounted in the insulating-material housing 2 on one side in a rotatable manner by the pivot pin 22 which serves as a bearing. In contrast, the operating lever 8 is only laterally guided in portions by insulating-material walls 2 and/or the busbar piece portion 5*a* of the insulating-material housing 2, without specific rotary mounting, on the opposite side which can be seen in FIG. 2.

As illustrated, the open operating lever 8 can hold itself in an over-dead-center position by a suitable contour of the operating portion in concert with the position of the rotation axis D.

It is also clear from FIGS. 2 and 3 that the clamping spring 4 is formed in the form of a U-shaped clamping spring with an abutment portion 21, an adjoining spring bow 23 and, adjoining said spring bow, a clamping portion 6 which extends approximately in the direction of the abutment limb 21.

Figure 4:
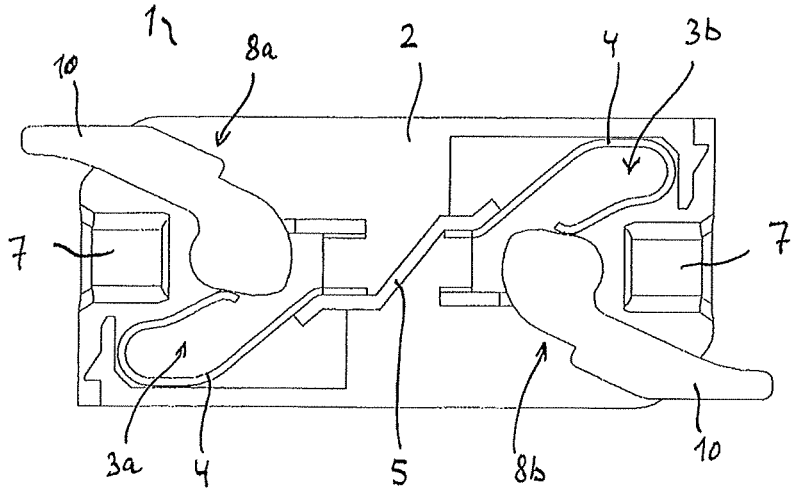
FIG. 4 shows a sectional side view of an embodiment of an embodiment of a connection terminal having operating levers which are arranged alternately on the upper side and lower side.

FIG. 4 shows a variant of the connection terminal 1 in a reduced sectional side view. It is clear that the operating lever 8*a* on the left-hand side of the spring-force terminal connection on the left-hand side projects upward out of the upper side of the insulating-material housing. In contrast, the operating lever 8*b* on the right-hand side of the spring-force terminal connection 3*b* on the right-hand side is arranged in a mirror-inverted manner with respect to said operating lever on the right-hand side in such a way that it projects out of the lower side of the insulating-material housing 2.

Further variants are feasible. This applies, in particular, to variants of connection terminals in which only one spring-force terminal connection and not, as in the exemplary embodiments according to FIGS. 1 and 4, two spring-force terminal connections 3*a*, 3*b* which are connected in series are provided, as seen over the length of the connection terminal. In these embodiments, a plurality of such spring-force terminal connections 3*a* are advantageously arranged in series, as seen over the width, that is to say in the viewing direction of FIG. 4. In order to save installation space, it may then be advantageous when the operating levers 8 project alternately on the upper side and the lower side as seen over the width.

In this case, a variant is also feasible in which the operating arms 10 project alternately firstly in the conductor insertion direction and, in the spring-force terminal connection 3 next to it, counter to the conductor insertion direction L from the rear side or front side.

In this case, a variant is also feasible in that not only does the direction of the operating arms 10 alternately change, but also the orientation of the operating levers are alternately such that they project out of the upper side and in an adjacent manner out of the lower side of the insulating-material housing 2 or are accommodated in recesses in the upper side and alternately the lower side.

Figure 5:
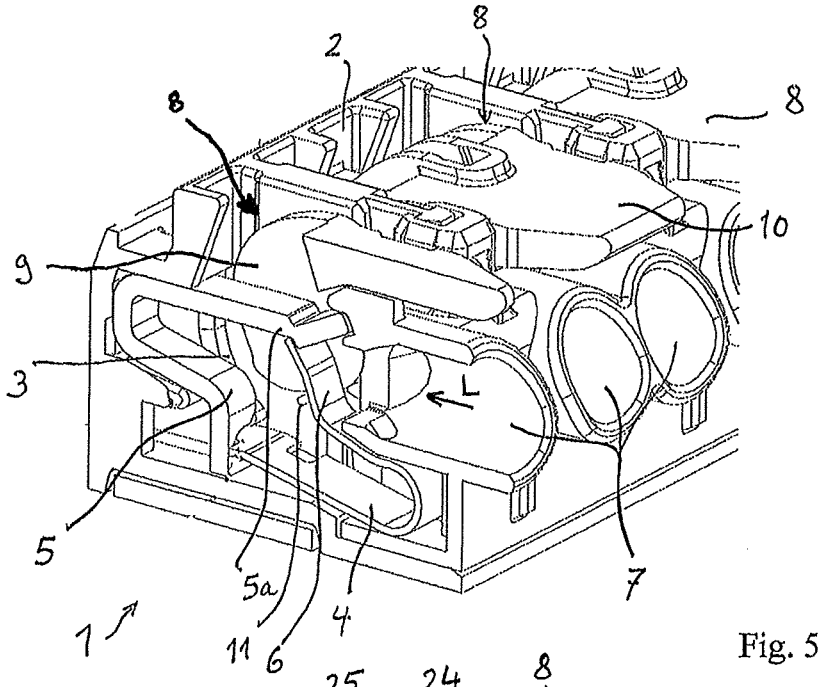
FIG. 5 shows a perspective sectional partial view of a multi-row connection terminal as an outlet box terminal.

FIG. 5 shows, for example, an embodiment of a multi-row connection terminal 1 in the form of an outlet box terminal. This connection terminal 1 has a plurality of spring-force terminal connections 3 which are situated next to one another and are electrically conductively connected to one another and of which the spring-force terminal connection on the left-hand side is shown. It can be seen that a clamping spring 4 is suspended in a busbar piece 5. The clamping spring 4 is again bent in the shape of a U, so that a clamping section 6 with a clamping cap at the free end to form a clamping point projects toward the busbar piece section 5*a*. In the unloaded state without electrical conductors clamping in, the clamping edge is situated on the busbar piece portion 5*a*.

In this embodiment, the clamping spring 4 has operating tabs 11 on both sides of the clamping portion 6.

The busbar pieces 5 of the spring-force terminal connections 3 which are arranged next one another obliquely toward the back-right can be electrically conductively connected to one another. However, an embodiment of the connection terminal 1 is also feasible in which in each case two spring-force terminal connections 3 which are situated next to one another are electrically conductively connected to one another and two or three pairs of such spring-force terminal connections 3 which are electrically conductively connected to one another are provided. Therefore, in each case two conductors for a single-phase voltage supply connection to the connections L (phase), N (neutral conductor) and PE (ground) are each connected to one another, so that a power supply system connection terminal is formed.

It is clear that the operating levers 8 are each arranged next to the clamping points, that is to say next to the busbar piece portion 5*a* and the clamping portion 6 immediately behind the end of the conductor insertion opening 7 formed in the insulating-material housing 2. The operating portions 9 of the operating levers 8 form a continuation of the wall of the respective conductor insertion opening 7, in order to guide an electrical conductor to the clamping point. Each operating portion 9 interacts with an associated operating tab 11 of the clamping spring 4. The rotation axis of the operating lever 8 is situated, as in the above-described exemplary embodiment, beneath the busbar piece portion 5 in the region of the clamping point. The rotation axis extends transverse to the conductor insertion direction which is predefined by the direction of extent of the conductor insertion opening 7.

It is also clear that the operating arms 10 extend counter to the conductor insertion direction L and are arranged on the upper side of the insulating-material housing 2. The free ends of the operating arms 10 are situated in the region of the front face. The free ends of the operating arms 10 are spaced apart from the boundary walls of the conductor insertion opening 7 or the insulating-material housing 2 in such a way that they can be grasped and pivoted.

It is clear from FIG. 5, in particular with reference to the conductor insertion openings 7 (illustrated in the center) with the adjoining operating lever 8, that an operating lever, in each case in the exemplary embodiment, is provided in each case to open two spring-force terminal connections 3 which are situated next to one another. As an alternative, in each case one operating lever 8 can be provided for each clamping point.

Figure 6:
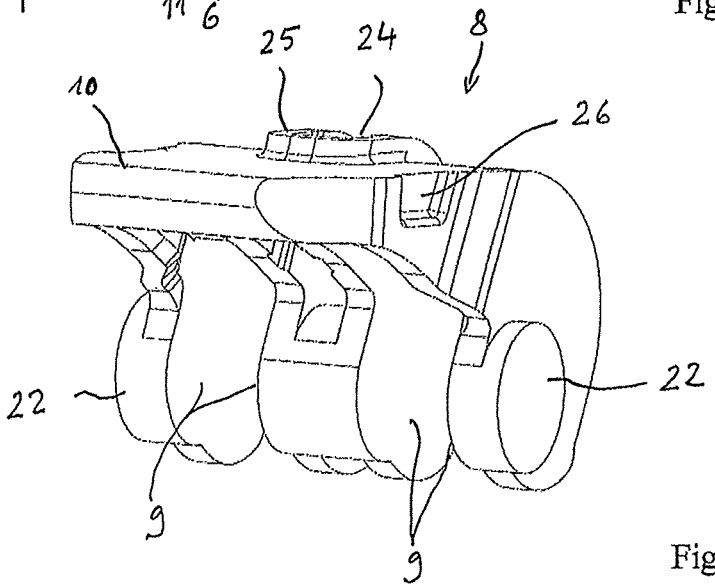
FIG. 6 shows a perspective illustration of an operating lever for the connection terminal from FIG. 5.

FIG. 6 shows a perspective view of such an operating lever 8 from the front side. However, it is clear in this case that there is an opening 24 in the middle, central region, a guide wall of the insulating-material housing entering said opening in order to guide the operating lever 8 in the insulating-material housing 2 such that it cannot tilt. The opening 24 is surrounded by a peripheral collar in the upper region. Said collar serves to strengthen and reinforce the operating lever 8.

It is also clear that the operating lever has a pivot pin 22, which serves as a bearing, at its two lateral outer ends. The pivot pins 22 are accommodated in corresponding openings in the insulating-material housing 2.

Said FIG. 6 also shows that in each case two mutually opposite operating portions 9 are provided for each spring-force clamping connection 3, so that an electrical conductor is guided on both sides of these operating portions 9 to the clamping point, after which the electrical conductors exit from the conductor insertion opening 7 from the laterally peripherally bounded conductor insertion opening 7 in the direction of the clamping point.

The mutually opposite operating portions 9 therefore serve as a continuation of the conductor insertion opening 7.

The operating levers 8 can have latching grooves 26 or projecting latching pins on the mutually opposite side edges of the operating arms 10, in order to latch the operating lever to the insulating-material housing 2 in the closed state and to prevent unintentional opening of the operating lever 8 with a reduced force.

Figure 7:
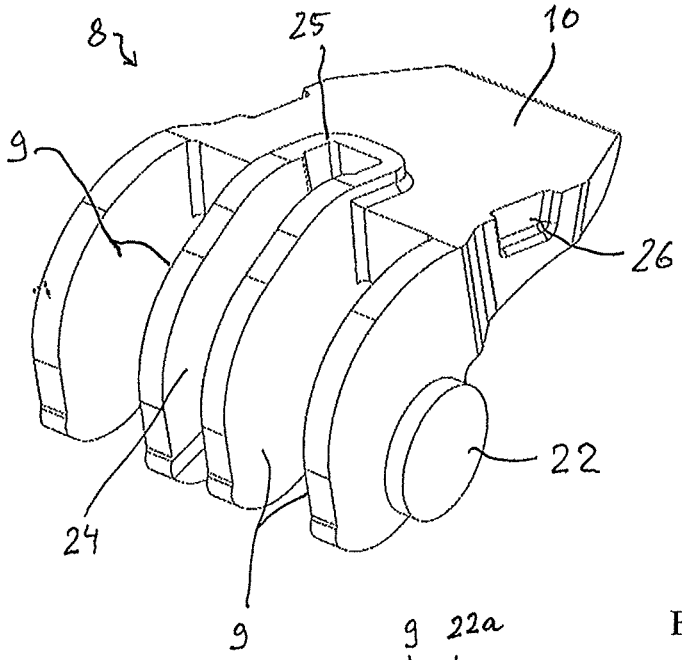
FIG. 7 shows a perspective rear view of the operating lever from FIG. 6.

FIG. 7 shows the operating lever from FIG. 6 in a view from the rear side. It is clear that the recess 24 which is designed as a slot is in the center of the operating lever 8.

Said FIG. 7 also shows the collar 25 which runs around the upper side of the operating arm 10 and merges with the walls which form the operating portions 9 with the opening 24 (slot) situated therebetween.

Figure 8:
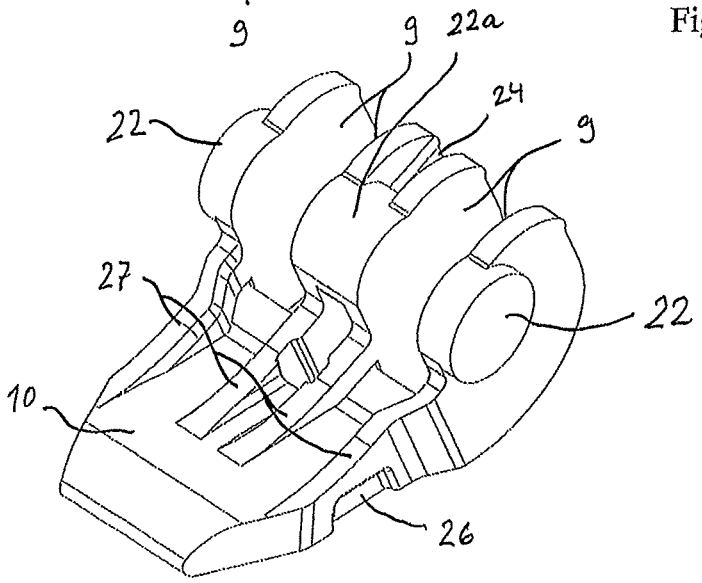
FIG. 8 shows a perspective view of the operating lever from FIGS. 6 and 7 from below.

FIG. 8 shows a perspective view of the operating lever from FIGS. 6 and 7 from the lower side. In this case, it is clear that the opening 24 is closed again in the lower region. It is also clear that the walls which form the operating portions 9 merge with the operating arm 10 by means of webs 27 to the lower side of said operating arm, in order to thereby reinforce the operating arm 10 and to prevent rebounding relative to the operating portions 9. The operating portions 9 have a contour, which is matched to the rotation axis D, in such a way that the open operating lever 8 remains in an over-dead-center position in a self-retaining manner.

Said FIG. 8 also shows that, in addition to the pivot pin 22 in the middle region, there is a guide area 22*a* for bearing purposes.

Figure 9:
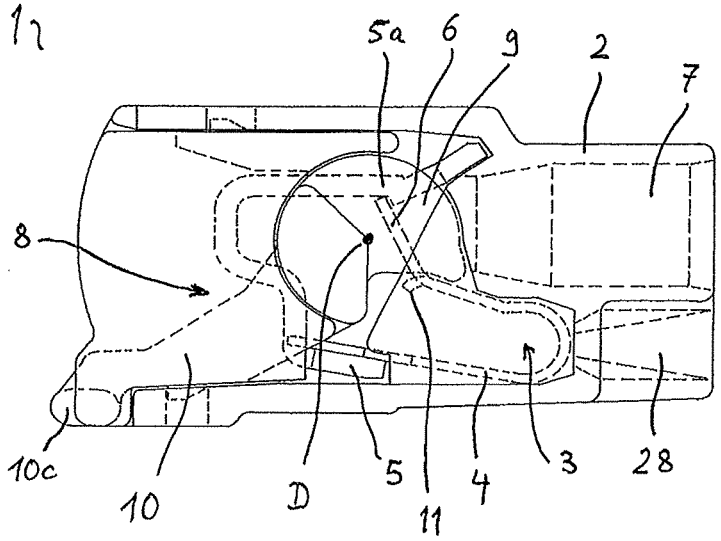
FIG. 9 shows a sectional side view of another embodiment of a multi-row connection terminal in the form of an outlet box terminal with operating levers, which are oriented toward the rear, in the closed position.

FIG. 9 shows a further embodiment of a connection terminal 1 having a plurality of spring-force terminal connections 3, which are arranged one behind the other in the viewing direction, and associated operating levers 8. In the illustration, the operating lever 8 is shown at the top in the closed position in which the clamping spring 4 of the spring-force terminal connection 3 is closed.

Figure 10:
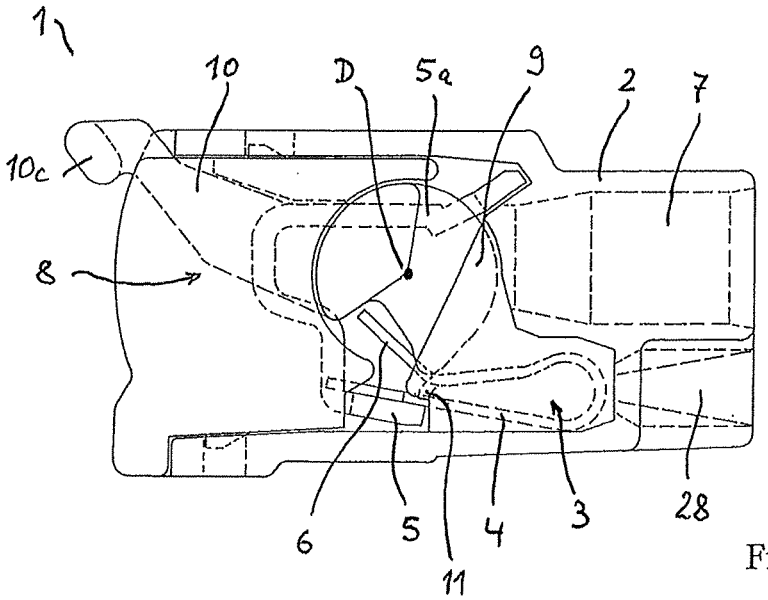
FIG. 10 shows a sectional side view of the connection terminal from FIG. 9 with the operating lever in the open position.

FIG. 10 shows the same operating lever 8 in the open position in which the spring-force terminal connection 3 is open.

It is clear that the operating lever 8, by way of its operating portion 9, is arranged immediately behind the conductor insertion opening 7, once again laterally next to the busbar piece 5 or the busbar piece portion 5*a* which forms the clamping point. The rotation axis D is again situated in the conductor insertion opening 7 or directly behind it and, as seen in the conductor insertion direction L, just in front of the clamping point and beneath the busbar piece portion 5*a* which forms the clamping point. The operating arms 10 of the operating levers 8 are directed in the direction of the rear side of the connection terminal 1 away from the conductor insertion opening 7 in the conductor insertion direction L. Therefore, a very compact construction of the connection terminal 1 together with a simple and reliable operation of the spring-force terminal connection 3 is made possible.

Said FIG. 10 also shows that a test opening 28 is provided on the rear side of the insulating-material housing 2 in the lower region, said test opening being open to the clamping spring 4. In this way, the voltage potential which is applied to the spring-force terminal connection can be measured with the aid of a test pin which is inserted into the test opening 28.

Figure 11:
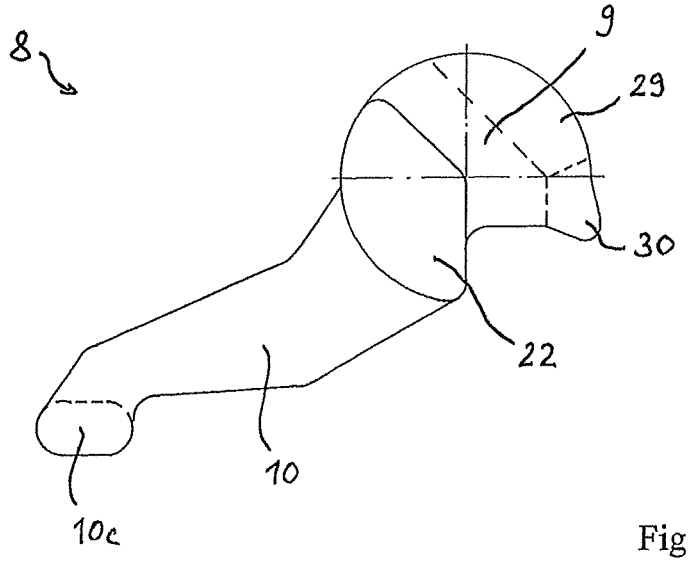
FIG. 11 shows a side view of an operating lever of the connection terminal from FIGS. 9 and 10.

FIG. 11 shows a side view of the operating lever 8 of the connection terminal 1 from FIGS. 9 and 10. It is clear that the operating arm 10 projects away from the operating portion 9 initially obliquely toward the rear and then in the conductor insertion direction L. Said FIG. 11 also shows the transverse piece 10*c* at the lower free end of the operating arm 10.

The operating portion 9 has a lug 30 which is matched to the position of the rotation axis such that the open operating lever 8 remains in an above-dead-center position in a self-retaining manner.

Figure 12:
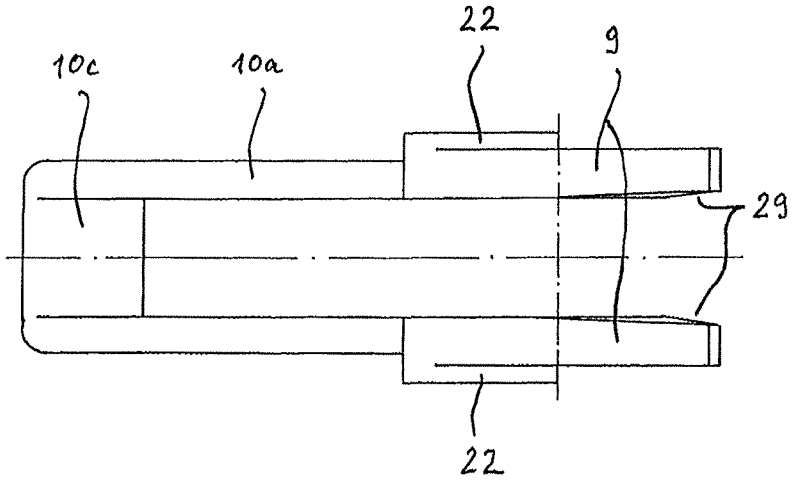
FIG. 12 shows a plan view of the lower side of the operating lever from FIG. 11.

FIG. 12 shows a plan view of the operating arm from FIG. 11 from below. Said figure clearly shows the construction of the operating arm 10 with two arm portions 10*a*, 10*b* and the transverse piece 10*c* which connects the arm portions 10*a*, 10*b* at the free end.

Said FIG. 11 also shows that pivot pins 22 project laterally at the outer sides of the operating portions 9 and are mounted in corresponding recesses in the insulating-material housing 2 of the connection terminal 1.

Said figure also shows that the mutually opposite inner sides of the operating portions 9 are inclined in the direction of the free end and have insertion slopes 29 for guiding an electrical conductor without interfering edges.

What is claimed is:

1. A Connection terminal, comprising:

at least one busbar piece;

at least one clamping spring;

at least one spring-force clamping connection, which is formed from the clamping spring and a portion of the busbar piece, in order to clamp an electrical conductor at a clamping point between a clamping portion of the clamping spring and the busbar piece portion;

an insulating-material housing which has at least one conductor insertion opening which leads to the associated spring-force clamping connection and extends in a conductor insertion direction;

at least one pivotably mounted operating lever which is designed to interact with the at least one clamping spring by means of an operating portion in order to open the at least one associated spring-force clamping connection when the operating lever is pivoted; and an operating arm which adjoins the operating portion, wherein the rotation axis of the operating lever is arranged transverse to the conductor insertion direction in an associated conductor insertion opening or the extension of the conductor insertion opening which continues in the conductor insertion direction to the clamping point.

2. The Connection terminal according to claim 1, wherein the operating lever has at least one lateral boundary wall for guiding an electrical conductor, which is inserted into a conductor insertion opening in the conductor insertion direction, to an associated clamping point.

3. The Connection terminal according to claim 1, wherein the at least one operating lever is arranged so as to be adjacent to an associated busbar piece portion, which forms the clamping point, such that the rotation axis of the operating lever is arranged in the space between the plane which is spanned by the busbar piece portion and a plane which is parallel thereto and in which the clamping edge of the clamping spring, which is fully open when the operating lever is pivoted, is situated.

4. The Connection terminal according to claim 1, wherein the at least one operating lever enters a cutout in the busbar piece, which cutout is made so as to be adjacent to a clamping portion of the associated busbar piece, and by way of an operating portion acts on an operating tab which is arranged next to the clamping portion of the clamping spring as seen over the width of an associated clamping spring, in order to open the clamping spring .

5. The Connection terminal according to claim 4, wherein the operating tab is released by the clamping spring and projects obliquely from the clamping portion of the clamping spring.

6. The Connection terminal according to claim 1, wherein the at least one clamping spring is a clamping spring which is bent in the shape of a U and of which the free clamping portion points obliquely in the direction of an associated busbar piece in order to allow an electrical conductor to be directly inserted without first opening the clamping spring by way of the associated operating lever.

7. The Connection terminal according to claim 1, wherein the at least one operating lever is rotatably mounted in the insulating-material housing of the connection terminal only on one side by way of a projecting pivot pin which is accommodated in a corresponding opening in the insulating-material housing of the connection terminal such that the at least one operating lever can rotate about the rotation axis which is defined by the pivot pin.

8. The Connection terminal according to claim 1, wherein the at least one operating lever has an operating arm which extends in the conductor insertion direction in the closed state of the associated spring-force clamping connection.

9. The Connection terminal according to claim 1, wherein the at least one operating lever has an operating arm which extends in the conductor insertion direction or counter to said conductor insertion direction on the lower side or upper side of the connection terminal.

10. The Connection terminal according to claim 1, wherein the connection terminal has at least one pair of opposing spring-force connection terminals with conductor insertion openings which run toward one another on the opposing front side and rear side of the connection terminal, with each spring-force connection terminal of a pair in each case being associated with an operating lever with an operating arm, the operating arms thereof pointing away from one another in opposite directions.

11. The Connection terminal according to claim 10, wherein the operating arms of a pair of operating levers are arranged on the same side or on opposite sides of the connection terminal.

* * * * *